US005771639A

United States Patent [19]

Wood et al.

[11] Patent Number: 5,771,639

[45] Date of Patent: Jun. 30, 1998

[54] EMERGENCY SHELTER

[76] Inventors: Marcus Bennett Wood; Wendy Margaret Wood, both of 26 King Street, Arundel, West Sussex, BN18 9BW, United Kingdom

[21] Appl. No.: 535,158

[22] PCT Filed: Apr. 19, 1994

[86] PCT No.: PCT/GB94/00823

§ 371 Date: Oct. 20, 1995

§ 102(e) Date: Oct. 20, 1995

[87] PCT Pub. No.: WO94/24380

PCT Pub. Date: Oct. 27, 1994

[30] Foreign Application Priority Data

Apr. 22, 1993 [GB] United Kingdom ..... 9308355

[51] Int. Cl.[6] ..... E04B 1/344; E04H 9/00

[52] U.S. Cl. ..... 52/71; 52/64; 52/81.1; 52/582.1; 52/DIG. 10; 135/130

[58] Field of Search ..... 52/81.1, 81.5, 52/64, 71, 223.1, 223.7, 223.14, 581, 582.1, DIG. 10; 135/124, 128, 130, 143, 900, 901, 902

[56] References Cited

U.S. PATENT DOCUMENTS

| | | | |
|---|---|---|---|
| D. 195,762 | 7/1963 | Gersin | 52/81.1 X |
| 2,874,812 | 2/1959 | Clevett, Jr. | 52/223.7 |
| 3,016,115 | 1/1962 | Harrison, III et al. | 52/71 X |
| 3,731,440 | 5/1973 | Welz | 52/71 |
| 4,035,964 | 7/1977 | Robinson | 52/71 X |
| 4,689,924 | 9/1987 | Jurgensen | 52/71 X |
| 4,779,388 | 10/1988 | Gibney | 52/71 |
| 4,829,726 | 5/1989 | de Potter d'Indoye | 52/64 X |

FOREIGN PATENT DOCUMENTS

| | | | |
|---|---|---|---|
| 1816876 | 5/1971 | Germany | 52/71 |
| 2454985 | 5/1975 | Germany | 52/71 |

*Primary Examiner*—Wynn E. Wood
*Assistant Examiner*—Kevin D. Wilkens
*Attorney, Agent, or Firm*—Oppenheimer Poms Smith

[57] ABSTRACT

A shelter (1) comprising an array of substantially rigid panels (2, 3, 4) hingedly joined together, the arrangement being such that a central polygonal roof panel (2) is surrounded by a number of wall panels (3) equal in number to the sides of the polygon, each wall panel having an edge hingedly attached to an edge of the roof panel, and a tension element (20) being arranged to extend along the edges of the wall panels remote from the roof panel in such a way that by applying tension to the tension element, adjacent edges of respective wall panels can be brought together to form a three-dimensional structure.

17 Claims, 3 Drawing Sheets

EMERGENCY SHELTER

The present invention relates to modular housing, and is particularly concerned with the provision of a lightweight, readily transportable and easily erectable shelter. The shelters are intended for use in providing long term or temporary shelter for displaced persons, refugees, etc., and to improve housing in undeveloped areas.

The currently conventional method of providing temporary shelter for refugees is to provide tented accommodation. This type of accommodation has several disadvantages, in that conditions are often insanitary, and the protection given from the elements is severely limited, particularly in colder climates. Further disadvantages of tent accommodation are the multiplicity of separate parts required to form the tent structure, giving rise to the loss or misplacement of parts and thus rendering the structure inoperable in some cases, and the degree of skill needed to erect the tent.

The present invention seeks to provide a readily transportable, lightweight and weatherproof shelter, which is easily erected using a minimum of unskilled labour, and which when erected can provide effective and sanitary shelter in a wide variety of climatic conditions.

A further advantage of the shelters of the present invention is that they are able to be placed one atop another or otherwise linked and configured, thus effectively increasing the housing density achievable.

According to the present invention, a shelter comprises an array of substantially rigid panels hingedly joined together, the arrangement of panels in the array being such that a central polygonal roof panel is surrounded by a number of wall panels equal in number to the sides of the polygon, each wall panel having an edge hingedly attached to an edge of the roof panel, and a tension element being arranged to extend along the edges of the wall panels remote from the roof panel in such a way that by applying tension to the tension element, adjacent edges of respective wall panels can be brought together to form a three-dimensional structure.

In a preferred embodiment of the invention, a shelter comprises polygonal roof and base panels of similar shape, and a number of wall panels each having a pair of parallel sides, a first one of the parallel sides of each wall panel being joined to a respective edge of the base or roof panel, and each wall panel being joined to another wall panel by a joint extending along the second of its parallel sides, at least one tension element being arranged to encircle the array of panels by passing along or adjacent the joints formed by the second parallel sides of each wall panel, the arrangement being such that when tension is applied to the tension elements, the joints between respective pairs of wall panels are drawn radially inwardly of the structure and the base and roof panels are urged apart.

A shelter according to the present invention will now be described in detail with reference to the accompanying drawings, in which.

Figure 4A:
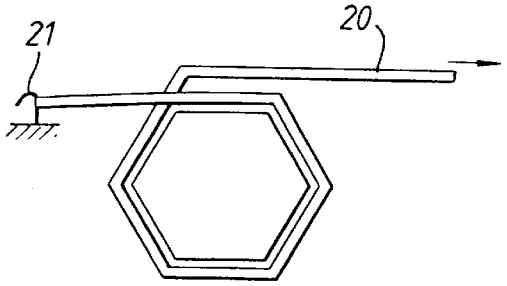
Figure 4B:
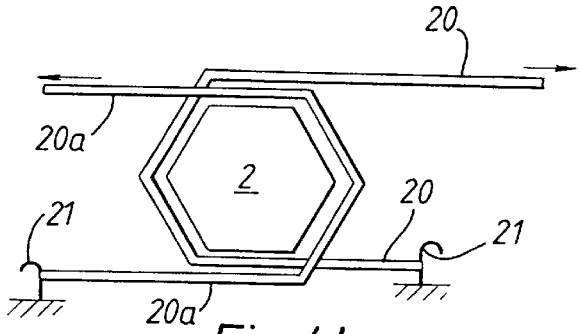
Figure 5:
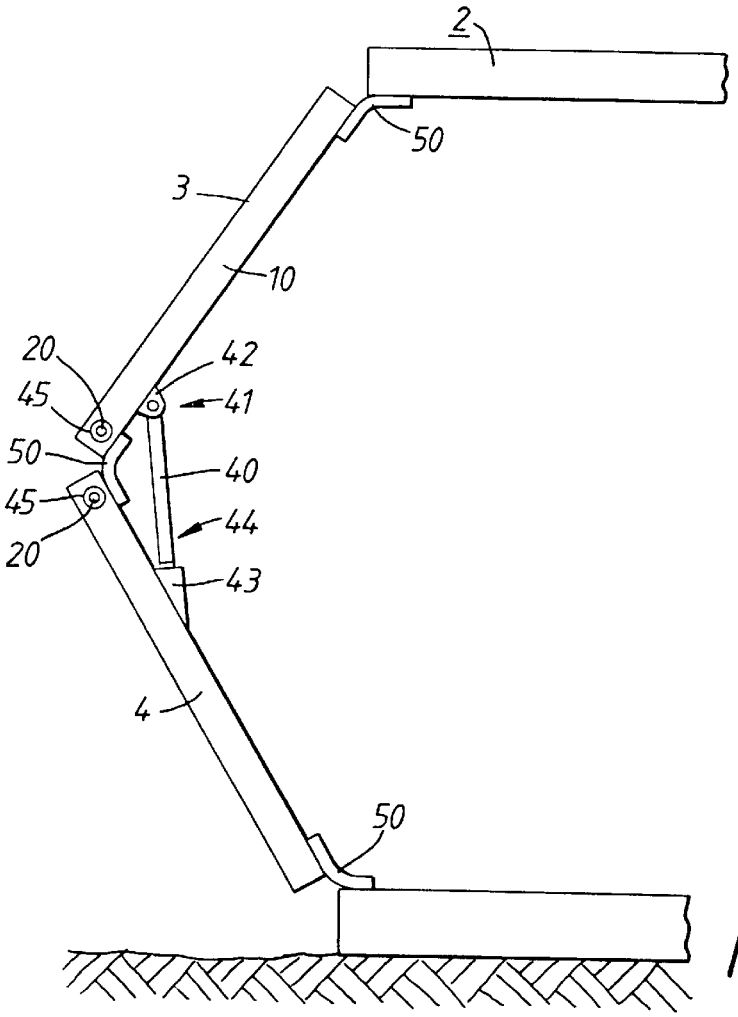

FIGS. 4*a* and 4*b* are schematic plan views showing alternative arrangements for the tension elements; and FIG. 5 is a schematic partial cross-sectional view through a shelter illustrating the principles of the invention.

Referring now to the drawings, there is seen a shelter 1 comprising a roof panel 2 of generally hexagonal shape, six upper wall panels 3, each of which is trapezoidal in shape, and six lower wall panels 4 similar in shape to the upper wall panels 3. A hexagonal base completes the structure.

Each of the trapezoidal lower wall panels 4 is joined to a respective side of the base by a hinged joint extending along the shorter of its parallel sides. Likewise, each of the upper wall panels 3 is joined to a respective edge of the roof panel 2 by a hinged joint extending along the shorter of its parallel sides 6. It is further noted that the shorter side of each panel 3 makes an obtuse angle with the shorter side of each adjoining panel 3.

Each upper wall panel 3 is joined to a lower wall panel 4 by means of a pivoting joint arranged along the lengths of the longer parallel sides 7 and 8 of the wall panels 3 and 4 respectively. The corner angles A of the trapezoidal wall panels 3 and 4 are arranged to be slightly less than 60 degrees, so that when the roof panel 2 lies in contact with the base panel, gaps exist between adjacent edges 9 and 10 of neighbouring upper and lower wall panels. In this configuration, the internal volume of the structure is minimised and a number of these structures can be packed flat and transported in a minimum volume.

A tension element 20 is arranged to encircle the shelter, the tension element 20 being guided within or adjacent the hinged joints between the upper and lower wall panels 3 and 4. Thus, in the collapsed condition of the structure, the tension elements 20 will extend across the gaps between neighbouring pairs of upper and lower wall panels.

Figure 1:
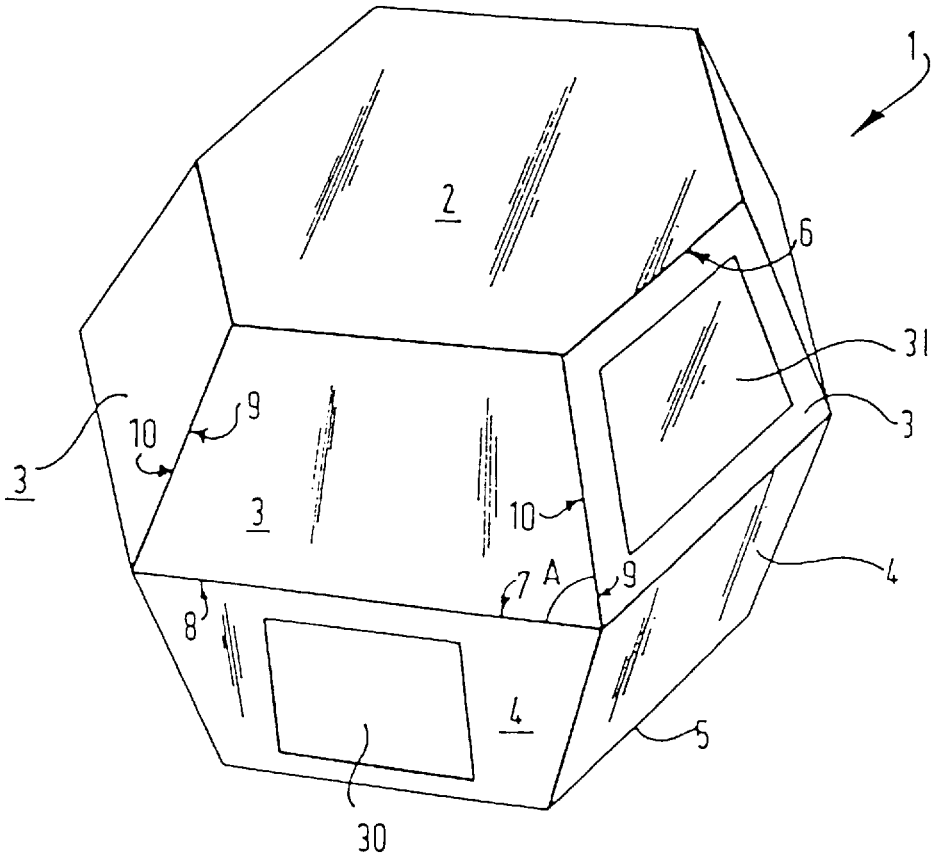
FIG. 1 is a perspective view of a shelter in the erected position.

By applying tension to the tension element, the hinged joints between upper and lower wall panels 3 and 4 are urged radially inwardly of the structure, the result being to space the roof panel 2 from the base panel, and to close the gaps so that edges 9 and 10 of adjacent wall panels meet. More specifically, with reference to FIGS. 2, 3 and 4*a* it may be appreciated that when the entire structure is flat on the ground, the tensioning element 20 will have a longer extent around the outer periphery of the adjacent edges of the upper wall panels 3 and the lower wall panels 4, than when the structure is fully erected, as shown in FIG. 1. Accordingly, by exerting force on the tensioning element 20, the structure may be erected from its flat stored configuration with the sides extending outwardly, to the fully erected state. In this condition the tension element is secured in order to retain the structure erect. As a safeguard against failure of the tension element, latching means may be arranged along adjacent edges 9 and 10 of the respective wall panels, so that by engaging the latching means, the tension element may be relaxed without the structure collapsing.

Figure 2:
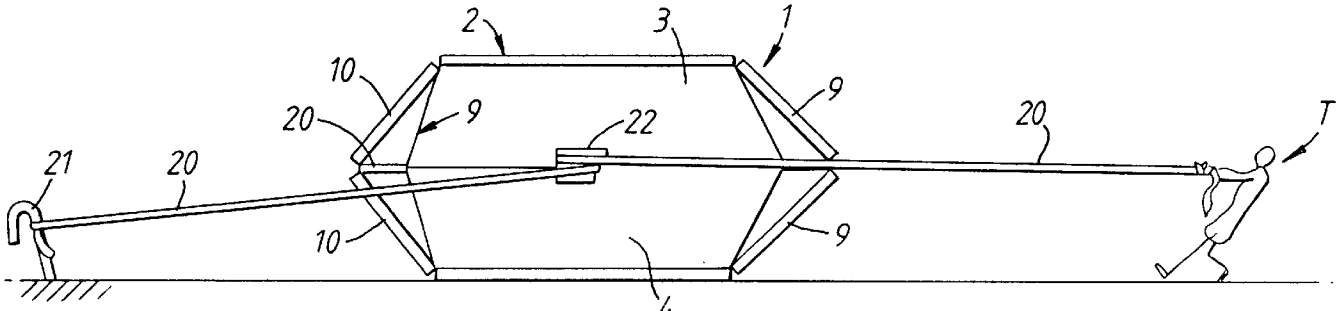
FIG. 2 is a side elevation of a stage in the erection process.
Figure 3:
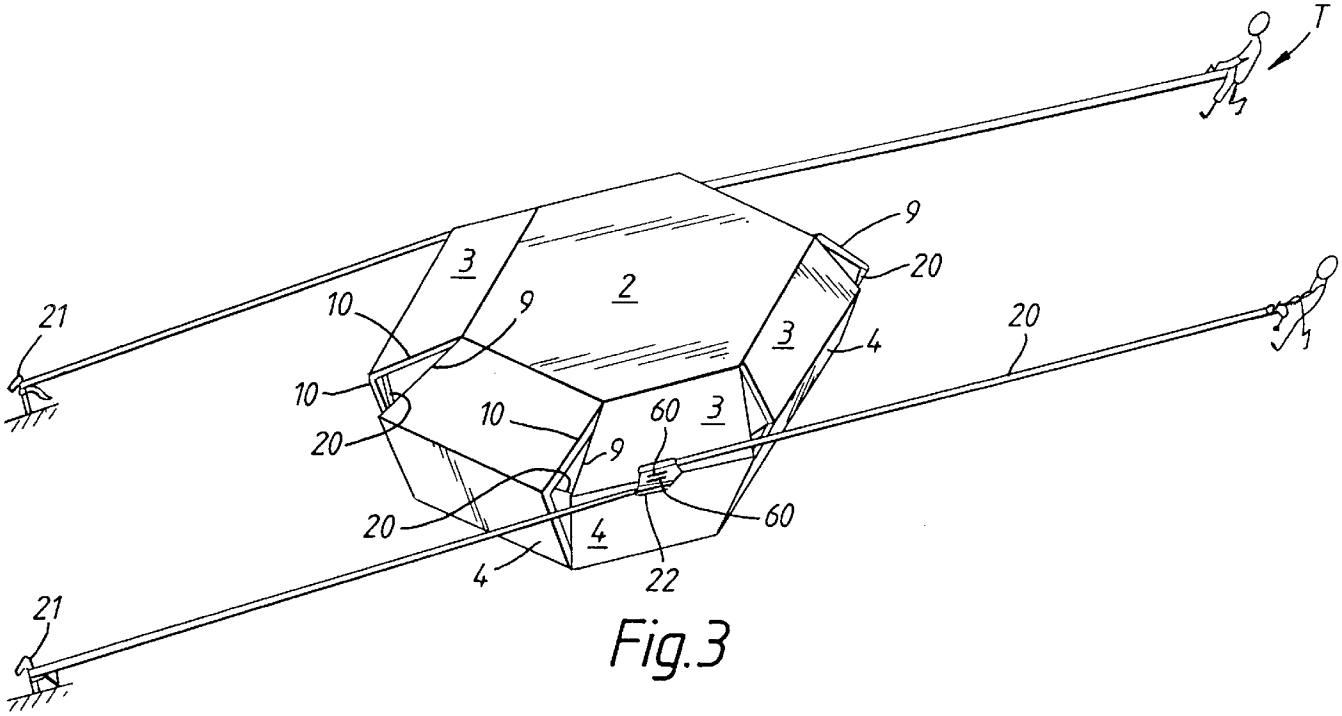
FIG. 3 is a perspective view of the erection process shown in FIG. 2.

As is shown in FIG. 2, tension may be applied to the tension element 20 by securing an end of the tension element 20, for example to a post 21 sunk into the ground, while pulling on the other end, the tension element extending from the post 21 to encircle the modular housing element 1, and then extending to a tension applying means T. The tension applying means may be manual, as illustrated, or may be a winch, a vehicle, or a draft animal.

It will readily by understood that, using the arrangement schematically shown in FIG. 4*a,* the shelter 1 may easily be erected by a single person applying tension to the tension element 20. If the tension required is too great to be generated by a single person pulling the tension element, the arrangement shown in FIG. 4*b* can be used in order to increase the available effort. Likewise, by wrapping the tension element 20 several times around the shelter, a mechanical advantage may be obtained to enable a single person easily to erect the shelter.

The tension element 20 is preferably led into a tubular guide extending along the pivot axis between the upper and lower wall panels 3 and 4 by means of a fairlead or tubular guide 22, which may be provided with a cleat 60 for temporarily securing the tension element during the erection procedure.

The base and roof panels, and wall panels of the dwelling unit are preferably formed from lightweight materials such as synthetic plastics material. By using an impervious outer skin of substantially rigid plastics material over a lightweight foamed plastics core, panels of light weight and high rigidity can be produced. Alternatively, the panels may be of a homogeneous rigid insulating material. In preferred embodiments of the invention, the edges 9 and 10 of the wall panels are equipped with sealing means such as lipped joints or rubber sealing gaskets, so that when the shelter is erected a draughtproof seal is effected between these edges. The hinges joining the roof, base and wall panels together are preferably weatherproof, and may be reinforced by strips of additionally flexible weatherproofing material. It is envisaged that upper wall panels 3 and the roof may be formed as a single unit incorporating flexible hinge lines, and the base and lower wall panels 4 be likewise formed as a single unit, by injection moulding for example. An advantageous feature of such a structure is that the free edges of the wall panels may be formed with interdigitating lugs penetrated by aligned bores to receive a tubular hinge pin joining each of the upper wall panels to a respective lower wall panel. Tension elements may be threaded through such tubular hinge pins.

It is however envisaged that the housing units may be produced not only from rigid homogeneous insulating plastics materials, but also from conventional material such as wood or light metal or textile materials, preferably in the form of sandwich panels having insulating cores of rigid plastics foam.

Door and window openings 30 and 31 respectively may be formed in the lower and upper wall panels 4 and 3. It is envisaged that the shelters will be formed from wall panels 3 and 4 which are identical, the openings 30 and 31 preferably being also identical and being characterized as door or window units by the fixing therein of either a door frame with a hinging door or by a window frame with a transparent window.

In a simplified embodiment of the invention, not illustrated, a shelter may comprise a roof panel 2 and a number of wall panels 3 joined at their lower edges by a tension element extending in guides running through the lower edges of the wall panels 3. Such a shelter is essentially the upper half of the structure shown in FIG. 1, and would provide rudimentary shelter with no integral floor to isolate the occupants from the ground. In such a shelter, and also in the floored shelters described above, the tension element or elements may be attached to the wall panels by guides spaced from the edges of the wall panels, so that for example the tension elements are guided parallel to but spaced from the lower edges of the wall panels in the floorless structure. Similarly, in the floored structure, two tension elements may be provided so as to extend parallel to and on either side of the horizontal joints between upper and lower wall panels. In their simplest form, the guides may be rings placed adjacent the panel edges and spaced from the hinged joints.

Although the shelters shown in the accompanying drawings are generally hexagonal in configuration, it should be understood that the roof panel 2 and base panel may be of any polygonal shape. While the hexagonal shape is preferred, it is also possible to construct shelters according to the invention having base and roof panels of any number of sides equal to or greater than three.

In a further advantageous embodiment of the invention, shown in FIG. 5, a bracing element is incorporated in the structure to maintain the structure erect in the event of a failure of the tension element. The preferred form of bracing element is a strut 40, one end 41 of which is hingedly attached to the upper wall element 3 by a bracket 42. The lower wall element 4 is provided with a socket 43, into which the other end 44 of the strut can be received. When the shelter is in its collapsed state, the strut 40 is pivoted relative to the upper wall element 3 so as to lie adjacent thereto, extending from the bracket 42 radially inwardly of the housing unit. As the shelter is erected by pulling the tension element 20, which extends through tubes 45 in the upper and lower wall elements 3 and 4, the strut 40 is pivoted away from the upper wall element 3 until its end 44 can enter the socket 43. By slightly relaxing the tension element at this time, the strut 40 can be engaged firmly in the socket 43 to support the structure of the housing unit by preventing the upper and lower wall elements 3 and 4 from pivoting towards each other about hinge 50. The strut 40 may be in the form of a hinged panel whose free edge is received in a channel formed on the lower wall element 4, or a series of separate bar struts may be provided. The struts may pivot towards their bracing positions under gravity, or may be resiliently or otherwise biased. Selectively operable resilient biasing means may act to urge the struts out of their bracing positions for dismantling the structure.

In FIG. 5, the hinges 50 between the upper and lower wall elements 3 and 4 and the base and roof 2 are shown as flexible strips attached to the adjacent edges of the hinged panels. While this will provide a weatherproof hinge, a conventional hinge may be used in conjunction with a weatherproofing seal extending over the hinged joint.

The preformed upper and lower wall elements 3 and 4 may be provided internally of the structure with attachment points for internal fittings such as suspension points for hammocks, lamps or water containers, storage fittings such as shelves or nets, or seating. The external surfaces may be configured to trap and channel rainwater to a discharge point for collection and storage, and may be provided with integral solar panels for heating or power generation.

We claim:

1. A shelter comprising a central polygonal roof panel surrounded by an array of wall panels equal in number to the number of sides of the roof panel, characterized in that all the wall panels each have two parallel sides of unequal length and the shorter of the parallel sides set at an obtuse angle to each of the adjoining sides, in that each such wall panel is hingedly attached at the shorter of the respective parallel sides to one side of the polygonal roof panel, and in that a tension element is provided attached to the wall panels at locations remote from the roof panel for maintaining adjacent sides of respective adjacent pairs of wall panels in contact by drawing said panels inwardly to form a three dimensional structure, which is collapsible to a coplanar array of said panels with said side panels extending outwardly from said roof on release of said tension; and said wall panels being freely pivotal to extend outwardly from said roof panel to form a substantially flat configuration with said roof panel when unconstrained by said tension member.

2. A shelter according to claim 1, wherein the tension element is releasably fixable to one of the wall panels.

3. A shelter according to claim 1, wherein the tension element is guided within a tubular element attached to the wall panels at the longer of the respective parallel sides.

4. A shelter according to claim 1, wherein the tension element comprises first and second tension element parts, each of which has a first end fixed to a first anchor point, a central part extending around a respective half of the circumference of the shelter, and a second end fixable to a second anchor point.

5. A shelter according to claim 1, wherein releasable latching means are provided to retain the wall panels in their erected relationship.

6. A shelter according to claim 1, wherein the adjacent sides of the wall panels are provided with sealing means to form a seal when the array panels are drawn inwardly.

7. A shelter according to claim 1, wherein a number of the wall panels are formed with openings to serve as windows and doors.

8. A shelter according to claim 1, wherein the roof panel is hexagonal.

9. A shelter according to claim 8, wherein the tension element is received in a guide element associated with each wall panel, the tension element being movable through the guide elements.

10. A shelter according to claim 8, wherein an end of the tension element is fixed to a first anchor point, and the tension element extends therefrom to form a loop surrounding the shelter, the other end of the tension element being fixable to a second anchor point.

11. A shelter according to claim 1, wherein an end of the tension element is fixed to a first anchor point, and the tension element extends therefrom to form a loop surrounding the shelter, the other end of the tension element being fixable to a second anchor point.

12. A shelter according to any of claim 11, wherein the anchor points for the tension element are mounted to the shelter structure.

13. A shelter according to claim 1, wherein the tension element is received in a guide element associated with each wall panel, the tension element being movable through the guide elements.

14. A shelter according to claim 13, wherein the tension element is releasably fixable to one of the wall panels.

15. A shelter according to claim 13, wherein an end of the tension element is fixed to a first anchor point, and the tension element extends therefrom to form a loop surrounding the shelter, the other end of the tension element being fixable to a second anchor point.

16. A shelter according to claim 13, wherein the tension element comprises first and second tension element parts, each of which has a first end fixed to a first anchor point, a central part extending around a respective half of the circumference of the shelter, and a second end fixable to a second anchor point.

17. A shelter comprising a central polygonal roof panel surrounded by an upper array of trapezoidal side wall panels equal in number to the number of sides of the roof panel, characterized in that all the wall panels each have two parallel sides of unequal length and the shorter of the parallel sides set at an obtuse angle to each of the adjoining sides, in that each such wall panel is hingedly attached at the shorter of the respective parallel sides to one side of the polygonal roof panel, and in that a tension element attached to the wall panels at locations remote from the roof panel is under tension and maintaining adjacent sides of respective adjacent pairs of wall panels in contact to form a three-dimensional structure which is collapsible to a coplanar array of said panels on release of said tension;

said shelter additionally including a lower array of trapezoidal side wall panels;

a polygonal base panel of similar shape to the roof panel, said lower array of trapezoidal wall panels each having one said wall panel hingedly attached at the shorter of its parallel sides to one side of the base panel, each upper wall panel being joined to a lower wall panel by a hinged joint extending along the longer of the parallel sides of the upper and lower wall panels, and at least one tension element being arranged mounted to the wall panels so as to encircle the arrays of panels by passing along the joints between the upper and lower wall panels, the arrangement being such that when the roof panel and its associated array of wall panels and the base panel and its associated array of wall panels are respectively disposed in substantially coplanar manner one above the other and joined by said joints and tension is applied to the tension elements, the joints between respective pairs of upper and lower wall panels are drawn radially inwardly of the structure and the base and roof panels are urged apart.

* * * * *